US006893281B2

(12) United States Patent
Taguchi

(10) Patent No.: US 6,893,281 B2
(45) Date of Patent: May 17, 2005

(54) HOUSING, CONNECTOR, AND CONNECTOR CONNECTING METHOD

(75) Inventor: Hiroyuki Taguchi, Kanagawa (JP)

(73) Assignee: J.S.T. Mfg. Co. Ltd., Osaka (JP)

( * ) Notice: Subject to any disclaimer, the term of this patent is extended or adjusted under 35 U.S.C. 154(b) by 0 days.

(21) Appl. No.: 10/689,709

(22) Filed: Oct. 22, 2003

(65) Prior Publication Data

US 2004/0137775 A1 Jul. 15, 2004

(30) Foreign Application Priority Data

Oct. 23, 2002 (JP) ..... 2002-308945

(51) Int. Cl.[7] ..... H01R 13/62
(52) U.S. Cl. ..... 439/326; 439/328
(58) Field of Search ..... 439/326, 328

(56) References Cited

U.S. PATENT DOCUMENTS

| | | | | |
|---|---|---|---|---|
| 5,288,247 | A | 2/1994 | Kaufman | |
| 6,354,876 | B1 | 3/2002 | Yu | |
| 6,390,842 | B1 * | 5/2002 | Hashimoto | 439/326 |

FOREIGN PATENT DOCUMENTS

| | | | |
|---|---|---|---|
| EP | 0926780 | A2 | 6/1999 |
| EP | 0932226 | A2 | 7/1999 |
| EP | 11195466 | A1 | 7/1999 |
| EP | 0932226 | A3 | 4/2000 |
| EP | 0926780 | A3 | 10/2000 |
| JP | 5-13131 | A1 | 1/1993 |
| JP | 5-34680 | A1 | 5/1993 |
| JP | 5-152025 | A1 | 6/1993 |
| JP | 6-19283 | U | 3/1994 |
| JP | 8-180942 | A1 | 7/1996 |
| JP | 3055342 | U | 10/1998 |
| JP | 11-195466 | A1 | 7/1999 |
| JP | 11-195467 | A1 | 7/1999 |
| JP | 2001-176624 | A1 | 6/2001 |
| JP | 2003-203692 | A1 | 7/2003 |
| JP | 2003-203718 | A1 | 7/2003 |
| JP | 2003-203719 | A1 | 7/2003 |
| JP | 2003-249314 | A1 | 9/2003 |
| JP | 2003-317892 | A1 | 11/2003 |

* cited by examiner

*Primary Examiner*—Ross Gushi
(74) *Attorney, Agent, or Firm*—Rader, Fishman & Grauer PLLC

(57) ABSTRACT

The present invention relates to a connector having a generally rectangular card and a housing having a generally box-shaped housing space for housing the card. The connector has a generally rectangular card and a housing having a generally box-shaped housing space for housing the card. The housing space includes a first side face; two second side faces adjoining the first side face, and an insert face adjoining the first side face and the second side faces for admitting the inserted card. The housing includes an engaging portion formed along the first side face of the housing space, and a pair of holding portions formed along the second side faces. Each of the holding portions includes a flexible portion extending along the second side face and elastically deformable outside, and a lock piece disposed along the flexible portion for covering a portion of the insert face. By lightly pushing the other end side of the card, the lock pieces can be pushed by the intermediate portions of the card, so that the card can be easily housed in the housing according to the principle of lever. Moreover, the connector can be made of a simple structure thereby to realize the size reduction of the connector.

10 Claims, 8 Drawing Sheets

HOUSING, CONNECTOR, AND CONNECTOR CONNECTING METHOD

BACKGROUND OF THE INVENTION

1. Technical Field

The present invention relates to a connector and, more particularly, to a connector provided with a rectangular card and a housing having a generally box-shaped housing space for housing the card.

2. Background Art

Conventionally, connectors which have a rectangular card and a housing having a generally box-shaped housing space for housing the card have been known. The following constructions have been known as such connectors.

For example, a card edge connector 100 has, as shown in FIG. 13, an insulating housing 110, a plurality of contacts 130, a pair of latch members 120, and a grounding auxiliary member 140 made of a metal for elastically contacting with the latch members 120 (as referred to JP-A-2000-208183). Here, the latch members 120 have child substrate holding members, and restore their initial positions, after they were once moved to the outer sides by the turning motion of a child substrate, thereby to prevent the child substrate from lifting.

For example, moreover, the edge connector has lock portions having slope portions, and touches the child substrate to the slope portions and press in the turning direction, so that movable portions are moved to hold the child substrate (as referred to JP-A-9-7692).

For example, moreover, an electric connector has a pair of latch members, each of which includes a taper face sloped from its upper portion to its lower portion apart from its rear portion, and an abutting face merging into the lower portion of the taper face and abutting against a printed circuit substrate member (as referred to Japanese Utility Model Registration No. 3,015,081).

For example, moreover, the card edge connector is provided with a skirt outer face. As the card turns, latch members are curved and elastically deformed in the direction apart from the side edge of the card by the cam action of the outer face of the card edge connector. When the side edge of the card passes through the frustum portions of semi-cone of the latch members, the bottom portions of the frustum portions of semi-cone of the latch members are held on the side edge of the card by the restoring force of the latch members (as referred to Japanese Utility Model Registration No. 3,040,313).

In the connectors thus far described, however, the slope portions of the latch members to be pushed by the card are sloped from the upper portions to the lower portions in the direction apart from the base portions. Therefore, it is difficult to keep the slope portions sufficient long, the card has to be forcibly pushed in so that it may be inserted. Moreover, the structure for holding the card is so complex that its size reduction is difficult.

DISCLOSURE OF THE INVENTION

Therefore, the object of the invention is to provide a housing, a connector, and connector connecting method which can house a card easily and which can be small-sized.

In order to achieve the above-mentioned object, the following constructions are adopted for the housing, connector and connector connecting method of the present invention.

(1) A connector comprising: a generally rectangular card; a housing having a generally box-shaped housing space for housing said card, said housing space including a first side face, two second side faces adjoining said first side face, and an insert face adjoining said first side face and said second side faces for admitting said inserted card; wherein said housing has an engaging portion formed along said first side face of said housing space, and a pair of holding portions formed along said second side faces, each of said holding portions having a flexible portion extending along said second side face and elastically deformable outside, and a lock piece disposed along said flexible portion for covering a portion of said insert face; and whereby said lock pieces pushed by end edges of said card to open outside when one end side of said card is engaged to said engaging portion and the other end side of said card is turned toward said housing, and said lock pieces lock said card when said card is housed in said housing space.

Here, an example of the card is a memory card. Moreover, the end edge of the generally rectangular card and the front end of the engaging portion may be straight or curvilinear, or continuous or discontinuous.

Moreover, one end side of the card and the engaging portions may be so engaged that the card can turn. One end side of the card is engaged the engaging portions, and the other end side of the card is turned toward the housing. At this time, the center of the turn need not be one end of the card.

According to the invention (1), while one end side of the card is being engaged the engaging portion, the other end side of the card is turned. Then, lengthwise intermediate portion of the card touches the lock pieces. When the card is further turned from this state, end edges of the card push the lock pieces and slide along the end edges of the lock pieces in the direction apart from the engaging portion. As a result, the lock pieces and the flexible portions are bent outside by the push of the card. When the card is housed in the housing space, the lock pieces are released from the pushing force of the card, so that the lock pieces return to their initial positions by the elastic restoring forces of the flexible portions and hold the card.

By lightly pushing the other end side of the card, therefore, the lock pieces can be pushed by the intermediate portions of the card, so that the card can be easily housed in the housing by the principle of lever. Moreover, the connectors can be made of the simple structure, so that their size reduction can be realized.

Here, by bending the flexible portions outside manually, the engagement between the lock pieces and the card may be released and the card may be extracted from the housing space.

(2) The connector as set forth in (1), wherein at least a portion of the end edge of said lock piece which touches said card is chamfered.

Here, the chamfered shape may be curvilinear or straight.

(3) The connector as set forth in (1) or (2), wherein an angle formed between the end edges of said lock pieces and the end edges of said card is 0 degrees or more, and less than 90 degrees.

The angle formed between the end edges of the lock pieces and the end edges of the card is desired to be as acute as possible for reduction of the force to push the card. Therefore, the angle formed between the end edges of the lock pieces and the end edges of the card is preferred to be 45 degrees or less and is more preferred to be 30 degrees or less.

(4) The connector as set forth in (1) or (2), wherein the one end side of said card is housed in said housing space and the other end side of said card is not housed in said housing space in a state when one end side of said card is engaged said engaging portions.

(5) The connector as set forth in (1) or (2), wherein said holding portions enclose said housing space.

(6) A housing comprising: a generally box-shaped housing space for housing a generally rectangular card, said housing space including a first side face, two second side faces adjoining said first side face, and an insert face adjoining said first side face and said second side faces for admitting said inserted card; an engaging portion formed along said first side face of said housing space; a pair of holding portions formed along said second side faces, each of said holding portions having a flexible portion extending along said second side face and elastically deformable outside, and a lock piece disposed along said flexible portion for covering a portion of said insert face; and whereby said lock pieces pushed by end edges of said card to open outside when one end side of said card is engaged to said engaging portion and the other end side of said card is turned toward said housing, and said lock pieces lock said card when said card is housed in said housing space.

Here, examples of the card are a memory card, a PC card, a SIMM, and a substrate. For example, this card is formed in the shape of a circular or a rectangular flat sheet and has a projection, a recess or an opening on its surface.

According to the invention (6), effects similar to those of (1) can be attained.

(7) The housing as set forth in (6), wherein at least a portion of the end edge of said lock piece which touches said card is chamfered.

(8) The housing as set forth in (6) or (7), wherein said card is substantially identical in shape to said insert face.

(9) The housing as set forth in (6) or (7), wherein said flexible portion is elastically deformable in a direction perpendicular to the turning direction of said card.

(10) A method for connecting a connector having a generally rectangular card, and a housing having a generally box-shaped housing space for housing said card, said housing space including a first side face, two second side faces adjoining said first side face, and an insert face adjoining said first side face and said second side faces for admitting said inserted card, said housing having an engaging portion formed along said first side face of said housing space, and a pair of holding portions formed along said second side faces, each of said holding portions having a flexible portion extending along said second side face and elastically deformable outside, and a lock piece disposed along said flexible portion for covering a portion of said insert face, the method comprising steps of: engaging one end side of said card to said engaging portion; turning the other end side of said card toward said housing so as to push said lock pieces with end edges of said card and open said lock pieces outside; and housing said card in said housing space so as to lock said card with said lock pieces.

PREFERRED EMBODIMENTS OF THE INVENTION

Figure 1:
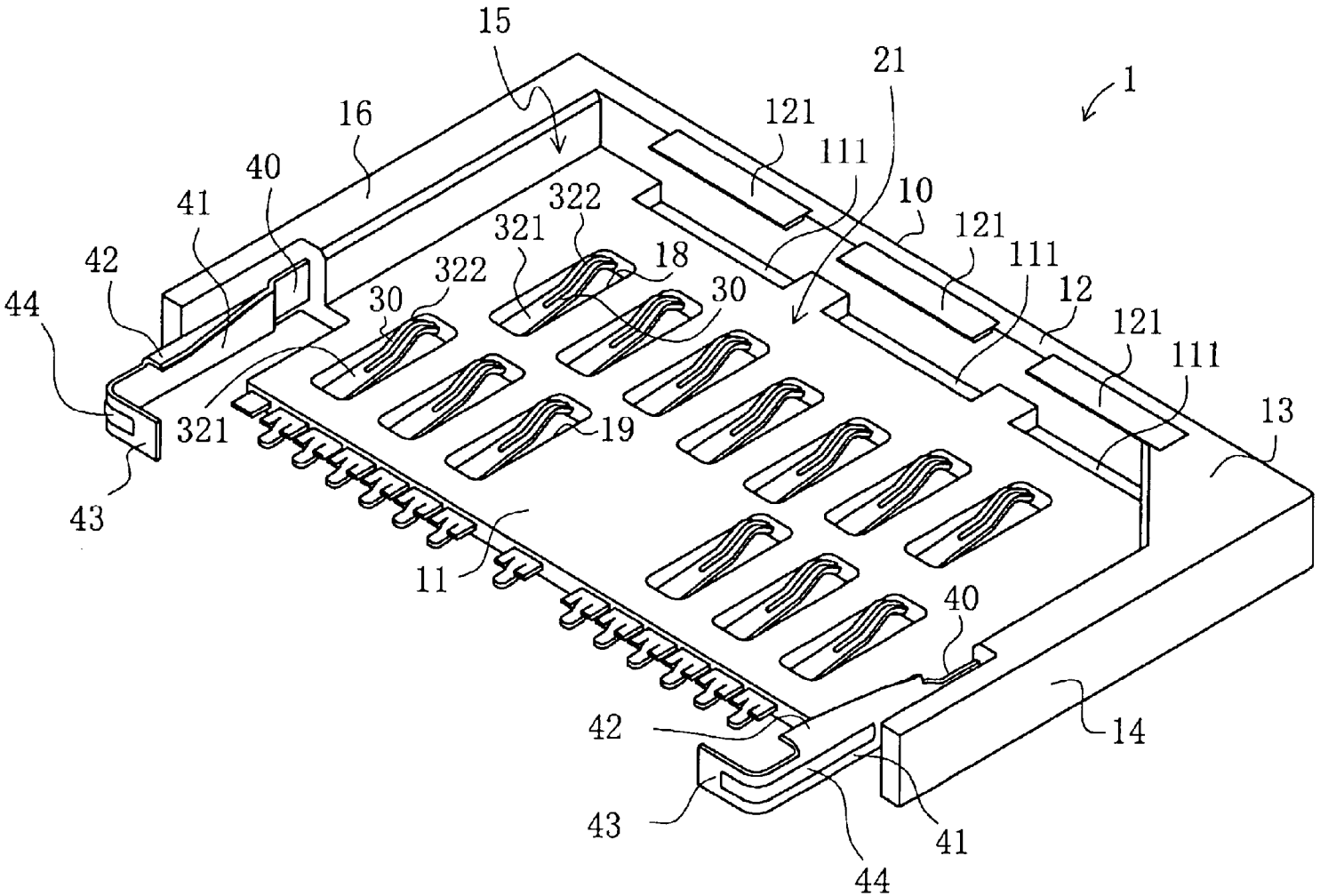
FIG. 1 is a general perspective view of a connector according to an embodiment of the present invention.

An embodiment of the present invention will now be described hereinafter by referring to the drawings.

Figure 2A:
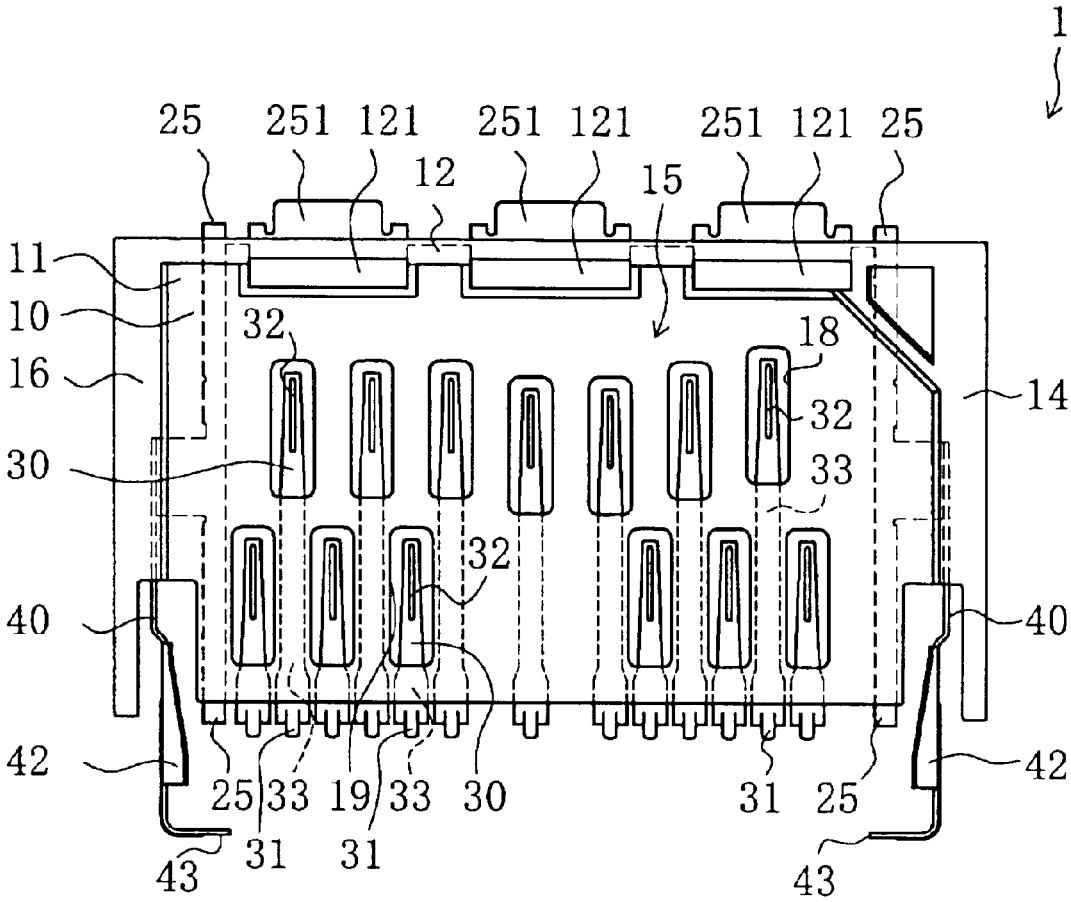
FIG. 2A is a plan view of the connector according to the embodiment.
Figure 2B:
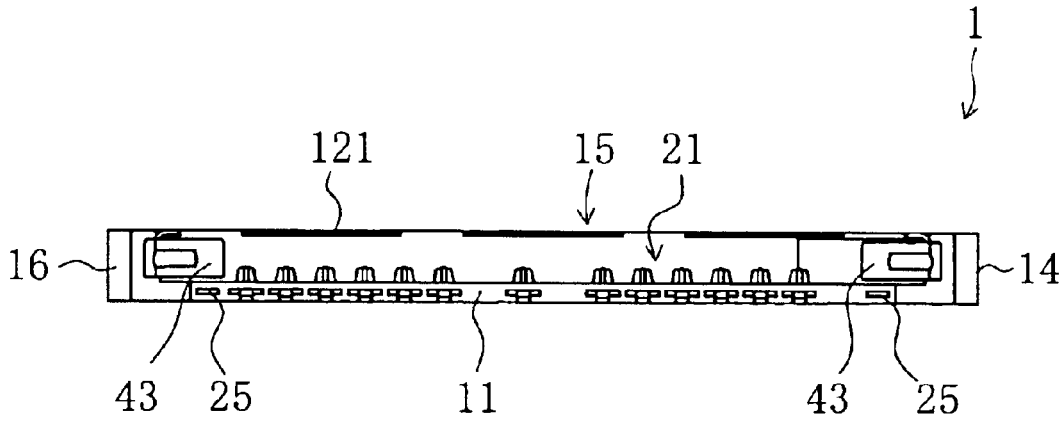
FIG. 2B is an elevation of the connector according to the embodiment.

FIG. 1 shows a general perspective view of a connector 1 according to this embodiment. FIG. 2A shows a plan view of the connector 1. FIG. 2B shows an elevation of the connector 1.

The connector 1 has a not-shown generally rectangular card, a housing 10 capable of housing the card therein, and a plurality of contacts 30 held in the housing 10.

This housing 10 is made of a resin and has a flat and rectangular housing base portion 11, a wall portion 12 installed upright along an edge of the housing base portion 11, and two wall portions 14, 16 installed upright along edges of the housing base portion 11 between which the wall portion 12 is sandwiched.

Here, the wall portion 14 is disposed on the front side of FIG. 1, and the wall portion 16 is disposed on the deep side of FIG. 1. At the corner between the wall portion 14 and the wall portion 12, a protruding corner portion 13 having generally triangular shape is formed. This protruding corner portion 13 makes a later-described insert face 15 asymmetric so that the card can be prevented from being transversely mistaken when it is inserted.

The housing base portion 11 and the wall portions 12, 14, 16 define a housing space 21. Specifically, the housing space 21 has a first side face covered with the wall portion 12, two second side faces adjacent the first side face and covered with the wall portions 14, 16, an open face 17 positioned on the opposite side to the first side face, and an insert face 15 adjacent the first side face, second side face, and the open face 17 through which the card can be inserted.

The housing base portion 11 has three openings 111 along the wall portion 12. This wall portion 12 has engaging portions 121, each of which is disposed in face-to-face relationship with those openings 111 and covers a portion of the insert face 15. These engaging portions 121 are the fulcrums for turning the other end side of the card while one end of the card is engaged to these engaging portions 121.

The wall portions 14, 16 have a pair of holding portions 40 on their extensions. Specifically, each holding portion 40 has an elastically deformable flexible portion 41 supported by the wall portion 14, 16 and extending along the second side face of the housing space 21, a first lock piece 42 disposed along the flexible portion 41 for covering a portion of the insert face 15, and a second lock piece 43 which is disposed generally perpendicularly with respect to the longitudinal axis of the flexible portion 41 at the front end of the flexible portion 41 for covering a portion of the open face 17.

The flexible portion 41 is deformable elastically and is supported in a cantilever fashion at the cutaway portion formed in the inner side of one end face of each of the wall portions 14, 16. Moreover, a reinforcing dimple 44 for improving the rigidity is formed in the intersection between the flexible portion 41 and the second lock piece 43. This reinforcing dimple 44 is formed at the time when the holding member 40 is to be pressed.

Figure 3:
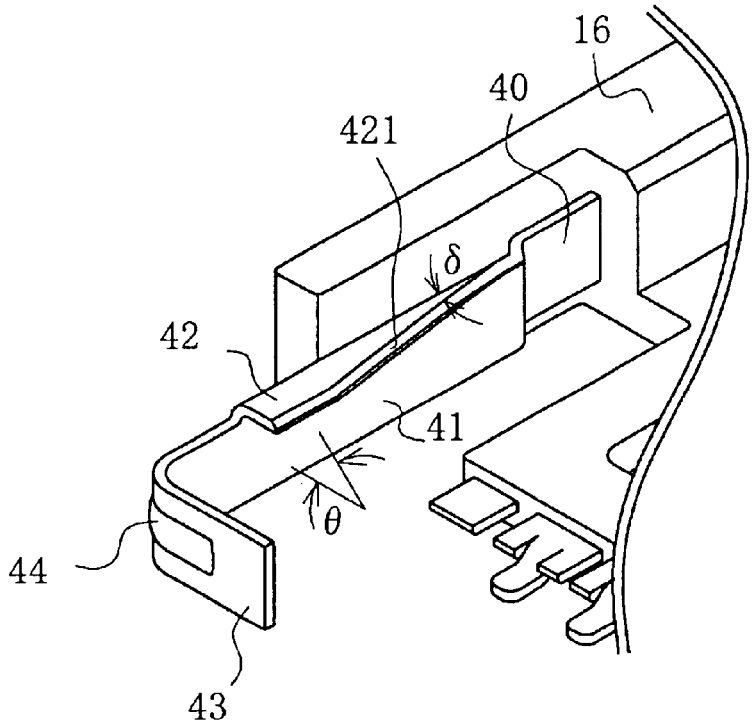
FIG. 3 is an enlarged perspective view of the connector according to the embodiment.

The first lock piece 42 is shaped, as shown in FIG. 3, to expand at a predetermined angle 6 from the rear end side to the front end side of the flexible portion 41. The expansion angle δ of the first lock piece 42 is about 10 degrees in this embodiment but may be suitably determined.

Moreover, the first lock piece 42 includes a slope 421 formed at the end edge thereof and the slope 421 slopes increasingly from the rear end side to the front end side. Specifically, the angle between the slope 421 and the insert face 15 is 0 degrees on the rear end side of the first lock piece 42 and a predetermined angle θ on the front end side of the first lock piece 42. The angle between the slope 421 and the insert face 15 is about 30 degrees in this embodiment but may be suitably determined.

Here in the first lock piece 42, the intersections between the slope 421 and the other surfaces of the first lock piece 42 are chamfered.

The housing base portion 11 has seven openings 18 which are formed on the side of the wall portion 12 and extend along the wall portions 14, 16. On the other hand, the housing base portion 11 has six openings 19 which are formed on the side of the open face (as opposed to the wall portion 12) and extend along the wall portions 14, 16. Three out of the six openings 19 offset with respect to the wall portion 14 and the other openings 19 offset with respect to the wall portion 16.

The number of the contacts 30 is thirteen and the contacts 30 are formed of a metal. Each contact 30 is has a buried portion 33 (as indicated by dashed lines in FIG. 2A) buried in the housing 10; a lead wire connecting portion 31 formed at one end side of the buried portion 33 so that it can connect a lead wire; and a card connecting portion 32 formed at the other end side of the buried portion 33 so that it can connect the inserted card.

Among them, the card connecting portion 32 is arranged in the openings 18, 19 of the housing base portion 11. The card connecting portion 32 has a spring portion 321 supported in a cantilever fashion at the end edge of the opening 18, 19, and a projection 322 formed at the front end of the spring portion 321. This spring portion 321 is elastically deformable and slopes the closer to the card side as it goes the farther toward the front end. As a result, the projection 322 protrudes into the housing space 21 so that it can hold a satisfactory contact pressure against the card.

The housing base portion 11 has a frame member 25 which is made of a metal and buried therein. This frame member 25 extends in a C-shaped sectional shape along the wall portions 12, 14, 16. The frame member 25 is connected to the above-mentioned three engaging portions 121 and the individual holding portions 40, and is exposed from the open face side of the housing base portion 11 and from the side of the wall portion 12.

As shown in FIG. 2A, the frame member 25 has three soldered portions 251, which are disposed at the positions corresponding to the engaging portions 121, and exposed from the side of the wall portion 12 of the housing base portion 11.disposed. These soldered portions 251 extended to the back side of the housing base portion 11 so that they can be soldered to the not-shown substrate. Moreover, this frame member 25 can prevent from deformation of the housing 10 due to a residual stress at the time of molding or the external stress.

Next, the procedure for inserting the card to the housing will be described with reference to FIG. 4 to FIG. 9.

Figure 4:
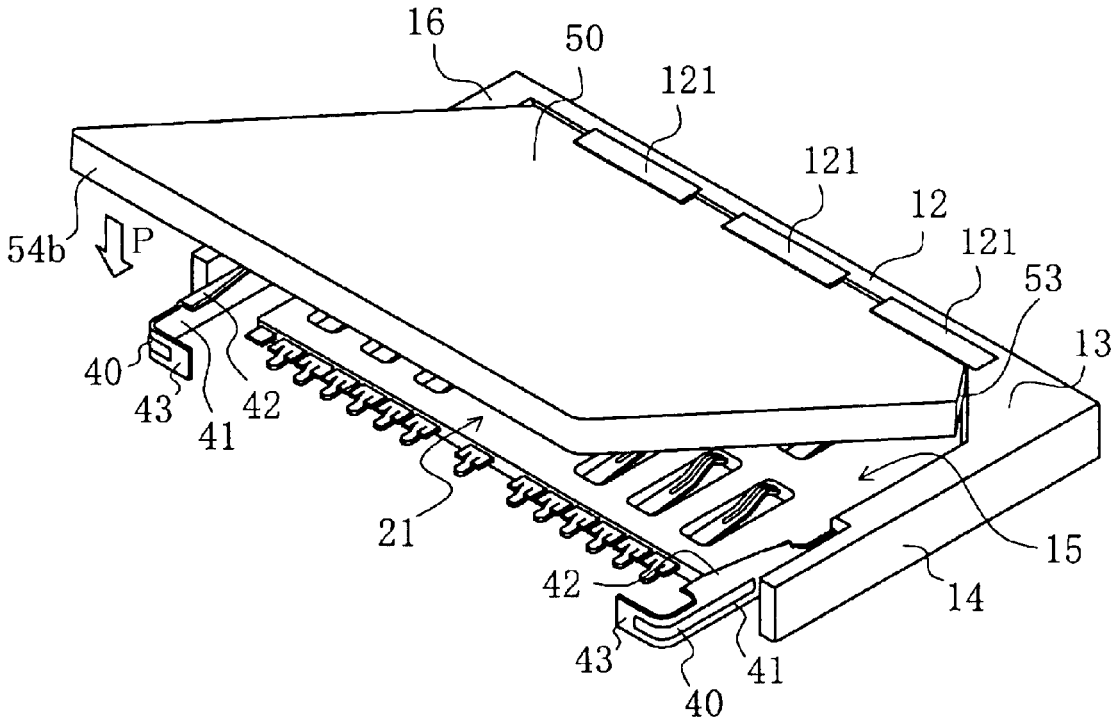
FIG. 4 is a perspective view showing the state in which a card is inserted into a housing according to the embodiment.

At first, a card 50 is prepared, as shown in FIG. 4. This card 50 is formed into such a generally rectangular shape as is cut out at a corner on its one end side to form a notch 53.

Next, one end of the card 50 is inserted between the engaging portions 121 and the housing base portion 11 until it contacts the wall portion 12 so that the notch 53 may be fitted into the protruding corner portion 13. At this time, the angle formed between the card 50 and the insert face 15 is 10 to 30 degrees, for example.

After this, the other end side of the card 50 is pushed in the direction of arrow P in FIG. 4 and turned. Then, the card 50 is turned with its one end side engaging the engaging portions 121 as the center of turn.

In this state, the one end side of the card 50 is inserted into the insert face 15 but the other end of the card 50 is not inserted into the insert face. In other words, the end edges of the lower face of the card 50 intersect the slopes 421 of the first lock pieces 42. Therefore, when the card 50 turns, the end edges of the lower face of the card 50 contact the slopes 421 of the first lock pieces 42 at contact points 46 as indicated by solid lines in FIG. 5 because the first lock pieces 42 cover a portion of the insert face 15. In short, the card 50 touches the first lock pieces 42 at its lengthwise intermediate portion.

Subsequently, the other end side of the card 50 is further turned in the direction of arrow P in FIG. 5 until the card 50 comes to the position of the dashed lines. Then, the end edges of the lower face of the card 50 slide in the direction apart from the engaging portions 121 along the slopes 421 of the first lock pieces 42 while pushing the slopes 421 of the first lock pieces 42, until they come into contact at contact points 48 with the slopes 421 of the first lock pieces 42.

Figure 5:
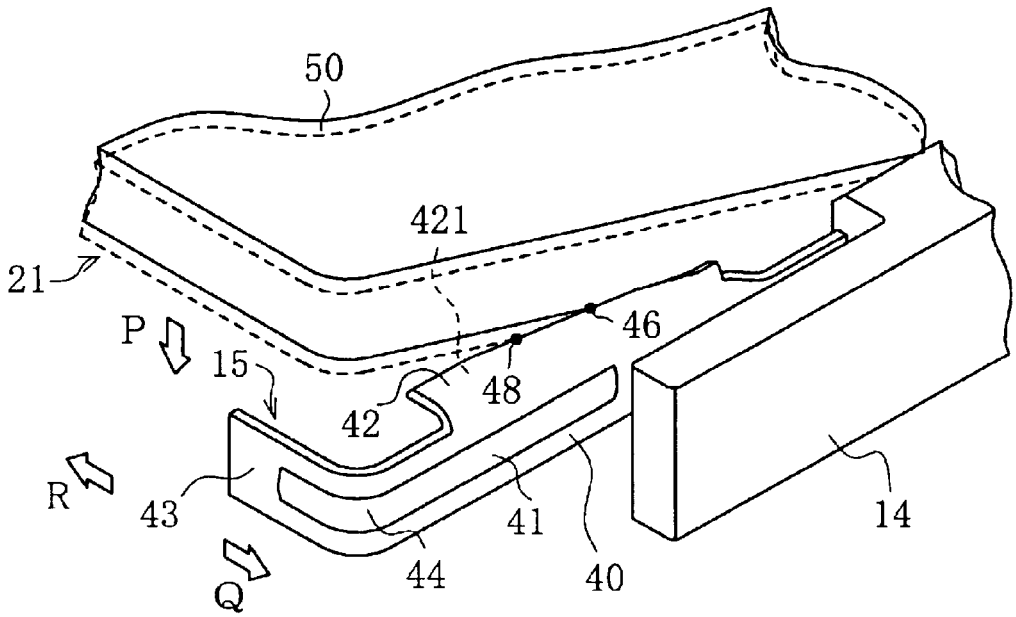
FIG. 5 is an enlarged perspective view showing the state in which the card according to the embodiment is turned.

As a result, the first lock piece 42 and the flexible portion 41 are pushed by the card 50 so that they are elastically deformed outside (in the directions of arrows Q in FIG. 5).

Figure 6:
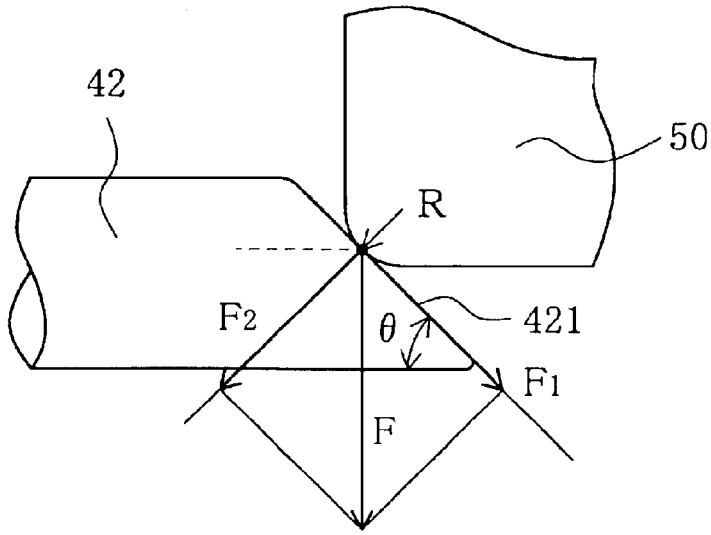
FIG. 6 is a schematic diagram showing the state in which the card according to the embodiment contacts a lock pieces.
Figure 7:
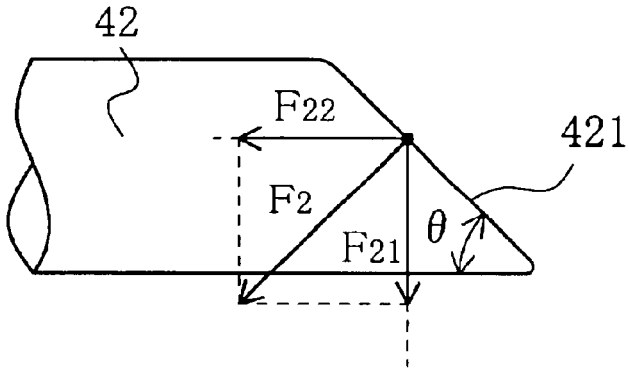
FIG. 7 is a schematic diagram for explaining a force which is generated between the card according to the embodiment and the lock pieces.

Specifically, as shown in FIG. 6, the end edge of the lower face of the card 50 pushes the slope 421 of the first lock piece 42 downward of FIG. 6 with a pushing force F. Then, this pushing force F can be resolved into a component F1 acting along the slope 421 and a component F2 acting vertically to the slope 421. As shown in FIG. 7, this component F2 acting vertically to the slope can be further resolved into a vertical component F21 and a horizontal component F22. Of these, the horizontal component F22 pushes the slope 421 of the first lock piece 42 outside.

The operation of the first lock piece 42 will be described in more detail with reference to FIG. 8 and FIG. 9.

Figure 8:
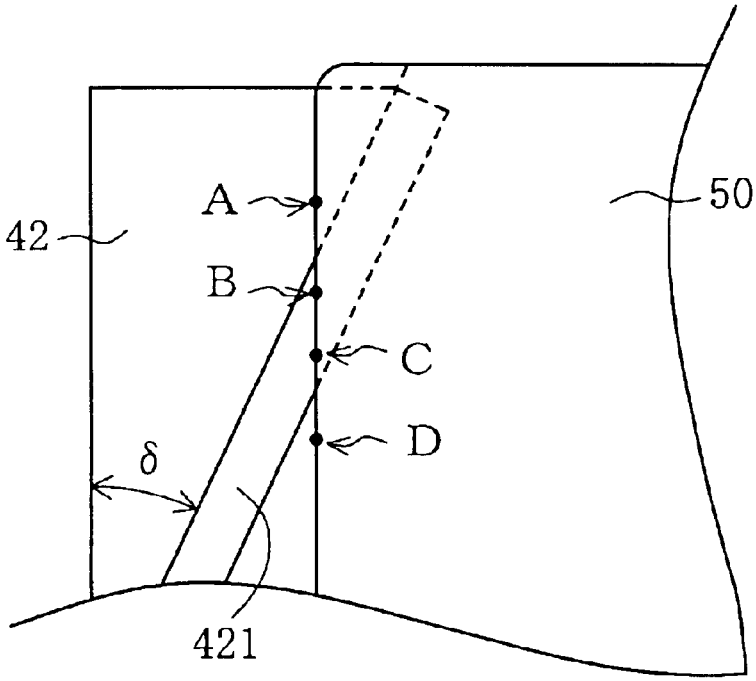
FIG. 8 is a schematic sectional view for explaining an operation of the lock pieces according to the embodiment.

It is assumed that virtual points A, B, C and D are spaced at a predetermined interval on the end edge of the lower face of the card 50, as shown in FIG. 8. As the card 50 turns, each of the virtual points A to D of the card 50 contacts and pushes the slope 421 of the first lock piece 42 in turn, as shown in FIG. 9. After this, each of the virtual points A to D leaves the slope 421 and passes over the insert face 15.

Figure 9:
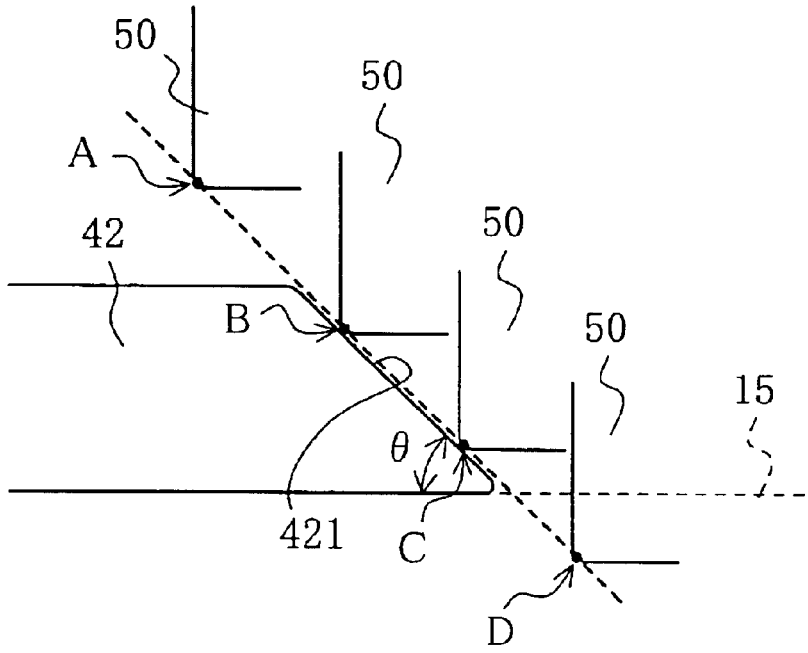
FIG. 9 is a schematic plan view for explaining an operation of the lock pieces according to the embodiment.

FIG. 8 and FIG. 9 show the state in which the virtual points B and C of the card 50 locate on the slope 421, the virtual point D has already passed over the insert face 15, and the virtual point A has not reached the insert face 15 yet.

Here, the expansion angle 6 of the first lock piece 42 and the angle θ between the slope 421 and insert face 15 may be suitably determined. With the smaller angle 67, for example, the movement of the first lock piece 42 per turn of the card 50 becomes the smaller. In other words, the force to push the card 50 can be reduced to insert the card 50 easily.

When the card 50 is housed in the housing space 21 as the card 50 is turned, the first lock piece 42 is released from the pushing force of the card 50. As a result, the first lock piece 42 is moved in the direction of arrow R in FIG. 5 to return to its initial position by the elastic restoring force of the flexible portion 41 so that its lower face holds the upper face of the card 50. On the other hand, the second lock piece 43 holds the side face of the card 50.

The present invention is not limited to the above-described embodiment but it includes the modifications and improvements of the embodiment which achieve the object of the present invention.

Figure 10:
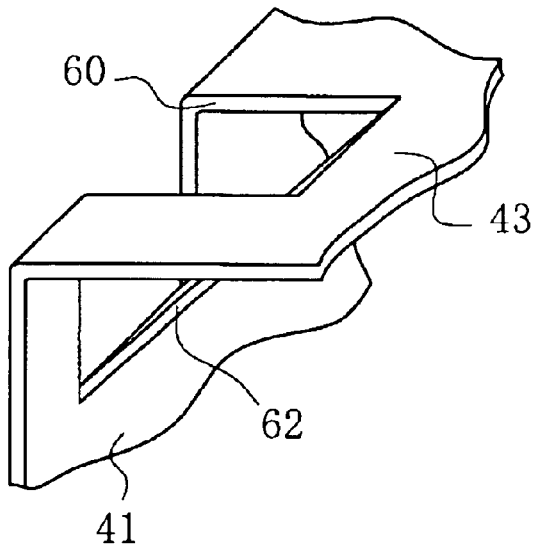
FIG. 10 is an enlarged sectional view of a connector according to first modification of the invention.
Figure 11:
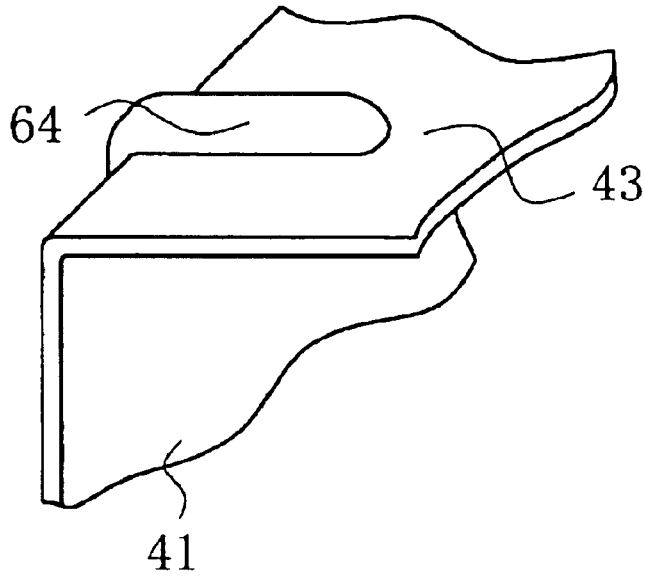
FIG. 11 is an enlarged sectional view of a connector according to second modification of the invention.
Figure 12:
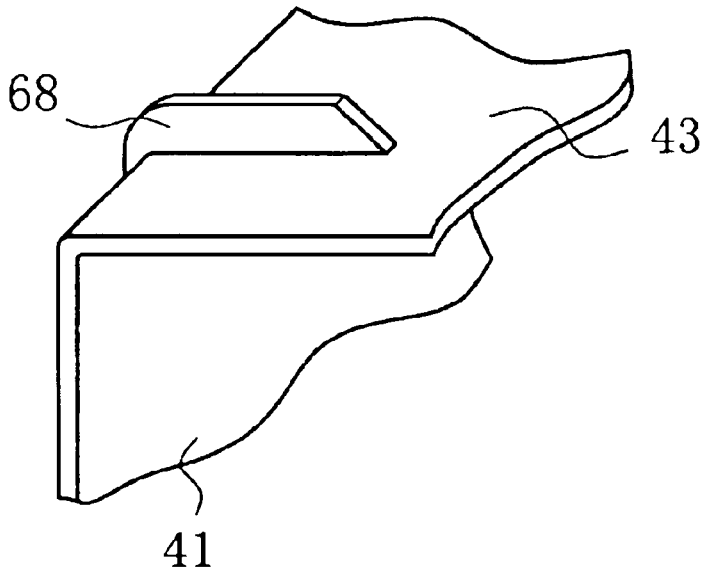
FIG. 12 is an enlarged sectional view of a connector according to third modification of the invention.
Figure 13:
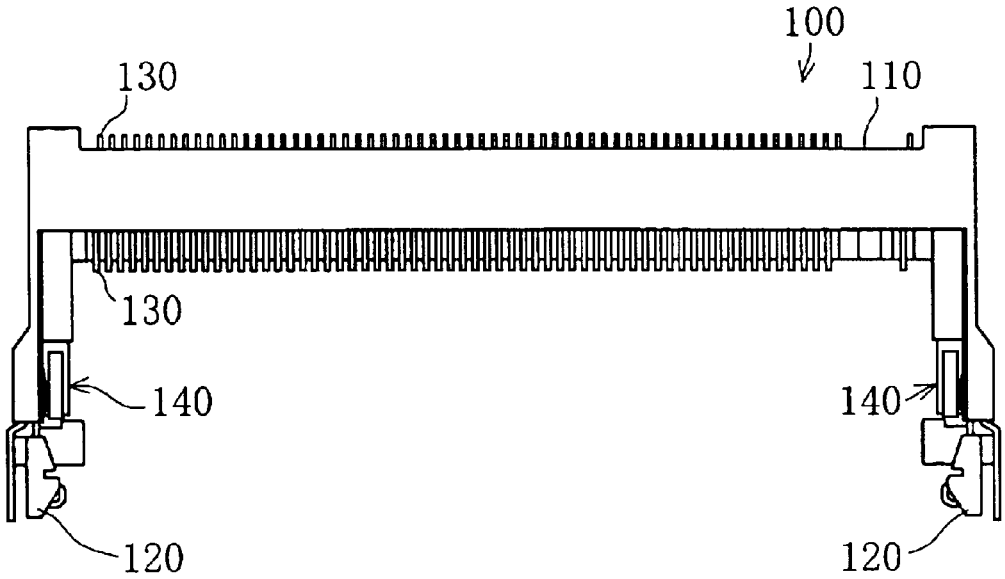
FIG. 13 is a plan view showing a card edge connector according to a conventional example.

For example, in the embodiment, the reinforcing dimple 44 is formed in the intersection between the flexible portion 41 and the second lock piece 43, but the present invention is not be limited thereto. As shown in FIG. 10, a cutaway portion 60 may be formed in the intersection between the flexible portion 41 and the second lock piece 43, for example, and a diagonal bracing 62 may be formed at that cutout portion 60. As shown in FIG. 11, moreover, a reinforcing bead 64 may be welded at the intersection between the flexible portion 41 and the second lock piece 43. As shown in FIG. 12, still moreover, a reinforcing rib portion 68 may be welded to the intersection between the flexible portion 41 and the second lock piece 43.

The following effects can be attained according to the housing, the connector and the connector connecting method of the invention.

While one end side of the card is being engaged the engaging portion, the other end side of the card is turned. Then, lengthwise intermediate portion of the card touches the lock pieces. When the card is further turned from this state, end edges of the card push the lock pieces and slide along the end edges of the lock pieces in the direction apart from the engaging portion. As a result, the lock pieces and the flexible portions are bent outside by the push of the card. When the card is housed in the housing space, the lock pieces are released from the pushing force of the card, so that the lock pieces return to their initial positions by the elastic restoring forces of the flexible portions and hold the card.

By lightly pushing the other end side of the card, therefore, the lock pieces can be pushed by the intermediate portions of the card, so that the card can be easily housed in the housing by the principle of lever. Moreover, the connectors can be made of the simple structure, so that their size reduction can be realized.

What is claimed is:

1. A connector comprising:

a generally rectangular card;

a housing having a generally box-shaped housing space for housing said card, said housing space including a first side face, two second side faces adjoining said first side face, and an insert face adjoining said first side face and said second side faces for admitting said card through said insert face;

wherein said housing has an engaging portion formed along said first side face of said housing space, and a pair of holding portions formed along said second side faces, each of said holding portions having a flexible portion extending along each of said second side faces away from said engaging portion, said flexible portion being bent elastically outside when being pushed, and a first planar lock piece disposed along said flexible portion for covering a portion of said insert face with a face of said planar lock piece, said first planar lock piece comprising a free edge on an inner side of the first lock piece with respect to the housing; and a second lock piece for covering a portion of an open surface adjoining the insert face and a forefront of the flexible portion, the open surface being generally disposed at right angles to the insert face and an extending direction of the flexible portion, said second lock piece being generally disposed on the open surface from the forefront of the flexible portion;

wherein said first planar lock piece is pushed on said free edge by each end edge of said card to open outside when one end side of said card is engaged to said engaging portion and the other end side of said card is turned toward said housing, and said lock pieces locks said card when said card is housed in said housing space.

2. The connector according to claim 1, wherein at least a portion of the free edge on an inner side of the housing is chamfered.

3. The connector according to claim 1 or 2, wherein an angle formed between the free edge and the extending direction of the flexible portion ranges from 0 to 45 degrees.

4. The connector according to claim 1 or 2, wherein the one end side of said card is housed in said housing space and the other end side of said card is not housed in said housing space when one end side of said card is engaged to said engaging portions.

5. A housing comprising:

a generally box-shaped housing space for housing a generally rectangular card, said housing space including a first side face, two second side faces adjoining said first side face, and an insert face adjoining said first side face and said second side faces for admitting said card through the insert face;

an engaging portion formed along said first side face of said housing space;

a pair of holding portions formed along said second side faces, respectively, said holding portions having flexible portions extending along said second side faces, respectively, said holding portions being elastically deformable outside, and planar first lock pieces disposed along said flexible portions, respectively, said first lock pieces covering a portions of said insert face and comprising free edges on respective inner sides of said first lock pieces with respect to the housing;

wherein said lock pieces are pushed on the free edges by side edges of said card to open outside when a front end side of said card is engaged to said engaging portion and a rear end side of said card is turned toward said housing, and said lock pieces lock said card when said card is housed in said housing space.

6. The housing according to claim 5, wherein at least a portion of the free edge of said first lock pieces is chamfered.

7. The housing according to claim 5 or 6, wherein said card is substantially identical in shape to said insert face.

8. The housing according to claim 5 or 6, wherein said flexible portions are elastically deformable in a direction perpendicular to the turning direction of said card.

9. The housing according to claim 5, further comprising: a second lock piece for covering a portion of an open surface adjoining the insert face and a forefront of one of the flexible portions, the open surface being generally disposed at right angles to the insert face and an extending direction of the one of the flexible portions, said second lock piece being generally disposed on the open surface from the forefront.

10. A method for connecting a connector having a generally rectangular card, and a housing having a generally box-shaped housing space for housing said card, said housing space including a first side face, two second side faces adjoining said first side face, and an insert face adjoining said first side face and said second side faces for admitting said inserted card, said housing having an engaging portion formed along said first side face of said housing space, and a pair of holding portions formed along said second side faces, each of said holding portions having a flexible portion extending along said second side face and elastically deformable outside, and a planar first lock piece disposed along said flexible portion for covering a portion of said insert face, and a second lock piece for covering a portion of an open surface adjoining the insert face and a forefront of the flexible portion, the open surface being generally disposed at right angles to the insert face and an extending direction of the flexible portion, the method comprising steps of:

engaging a front end side of said card to said engaging portion;

turning a rear end side of said card toward said housing so as to push said lock pieces with side edges of said card and move said lock pieces outside; and housing said card in said housing space so as to lock said card with said lock pieces.

* * * * *